US008434557B2

(12) United States Patent
Chaddick

(10) Patent No.: US 8,434,557 B2
(45) Date of Patent: May 7, 2013

(54) METHODS AND SYSTEMS FOR CONTROLLING FLOW OF HYDROCARBONS FROM A STRUCTURE OR CONDUIT

(76) Inventor: Johnny Chaddick, Duson, LA (US)

( * ) Notice: Subject to any disclaimer, the term of this patent is extended or adjusted under 35 U.S.C. 154(b) by 293 days.

(21) Appl. No.: 12/804,944

(22) Filed: Aug. 2, 2010

(65) Prior Publication Data

US 2012/0024384 A1 Feb. 2, 2012

(51) Int. Cl.
*E21B 17/01* (2006.01)

(52) U.S. Cl.
USPC ..... 166/344; 166/352; 166/367; 285/355; 285/382.7; 405/169; 405/224.2

(58) Field of Classification Search ..... 166/344, 166/338, 341, 345, 351, 352, 363, 364, 367, 166/373, 97.1; 285/355, 382.7; 403/278, 403/281, 282; 405/158, 169, 184.4, 224.2–224.4
See application file for complete search history.

(56) References Cited

U.S. PATENT DOCUMENTS

| | | | | | |
|---|---|---|---|---|---|
| 1,485,862 | A * | 3/1924 | Lester | 166/97.1 |
| 1,664,643 | A * | 4/1928 | Rasmussen | 166/92.1 |
| 1,807,498 | A * | 5/1931 | Teed | 166/95.1 |
| 1,828,124 | A * | 10/1931 | Bower | 166/92.1 |
| 2,897,895 | A * | 8/1959 | Ortloff | 166/95.1 |
| 4,026,354 | A * | 5/1977 | Burrow | 166/95.1 |
| 4,201,267 | A * | 5/1980 | Ramhorst | 166/373 |
| 4,323,118 | A * | 4/1982 | Bergmann | 166/96.1 |
| 4,336,843 | A * | 6/1982 | Petty | 166/353 |
| 4,417,624 | A * | 11/1983 | Gockel | 166/351 |
| 4,461,354 | A * | 7/1984 | Buras et al. | 166/343 |
| 4,568,220 | A * | 2/1986 | Hickey | 405/60 |
| 4,635,728 | A * | 1/1987 | Harrington | 166/341 |
| 5,121,793 | A * | 6/1992 | Busch et al. | 166/79.1 |
| 5,150,752 | A * | 9/1992 | Gunst et al. | 166/97.1 |
| 5,213,157 | A * | 5/1993 | Wills | 166/79.1 |
| 5,361,840 | A * | 11/1994 | Matthews | 166/285 |
| 5,522,681 | A * | 6/1996 | Pallini, Jr. | 405/223.1 |
| 6,189,620 | B1 * | 2/2001 | McDowell | 166/379 |
| 6,488,094 | B1 * | 12/2002 | McDowell | 166/379 |
| 6,675,889 | B1 | 1/2004 | Mullins et al. | |
| 6,857,473 | B2 | 2/2005 | Cook et al. | |
| 7,341,109 | B1 * | 3/2008 | McDowell | 166/379 |
| 7,513,309 | B2 * | 4/2009 | Ruttley et al. | 166/341 |
| 7,588,270 | B2 * | 9/2009 | Durand et al. | 285/390 |
| 7,699,361 | B2 * | 4/2010 | Verger et al. | 285/382.4 |
| 7,987,903 | B1 * | 8/2011 | Prado Garcia | 166/75.13 |
| 8,016,030 | B1 * | 9/2011 | Prado Garcia | 166/75.13 |
| 8,025,103 | B1 * | 9/2011 | Wolinsky | 166/364 |

(Continued)

*Primary Examiner* — Matthew Buck
(74) *Attorney, Agent, or Firm* — The Matthews Firm

(57) ABSTRACT

Methods and apparatuses for controlling the flow of hydrocarbons from a structure or conduit are provided. An engagement apparatus having a body with threads disposed on an end is lowered into a position suitable for engagement with the structure or conduit, the threads including a deformable material. Rotation of the apparatus to engage the threads with the structure or conduit deforms the material to form a wedge shape that provides a seal between the apparatus and structure or conduit, and resists removal of the apparatus from the structure or conduit. Additional conduits can be secured to the upper end of the apparatus, in combination with a valve. The valve can direct the flow of hydrocarbons from the structure or conduit to selected additional conduits, enabling vessels and/or containers to be removed and/or replaced without wholly ceasing the flow of hydrocarbons in a manner that could cause a buildup of pressure.

20 Claims, 4 Drawing Sheets

U.S. PATENT DOCUMENTS

2005/0172472 A1* 8/2005 Verger et al. ..... 29/507
2005/0212290 A1* 9/2005 Durand et al. ..... 285/333
2010/0038076 A1 2/2010 Spray et al.
2011/0303416 A1* 12/2011 Herman, II ..... 166/350
2011/0315393 A1* 12/2011 Wolinsky ..... 166/363
2012/0000666 A1* 1/2012 Cochrane ..... 166/363
2012/0012329 A1* 1/2012 Klapyk et al. ..... 166/363
2012/0018174 A1* 1/2012 Kotefski et al. ..... 166/386

* cited by examiner

METHODS AND SYSTEMS FOR CONTROLLING FLOW OF HYDROCARBONS FROM A STRUCTURE OR CONDUIT

FIELD

The present invention relates, generally, to methods and systems usable to engage a preexisting structure or conduit, such as a damaged blow out preventer or casing string, for controlling the flow of hydrocarbons therefrom.

BACKGROUND

When a blow out preventer or subsea casing string fails, the resulting blow out can cause catastrophic damage to associated rigs and other equipment, injury and loss of life, and severe environmental impact from hydrocarbons that escape into the ocean. To at least partially reduce the uncontrolled exodus of hydrocarbons into the environment, the casing string can be sheared to provide a generally straight surface, which can be engaged by a cover having one or more openings therein. It is necessary that such a cover be provided with openings that permit the passage of at least a portion of the hydrocarbons therethrough due to the fact that wholly covering a failed blow out preventer or casing string will cause a pressure build-up that will forcibly remove the cover, or damage the blow out preventer or casing string at another point to enable exodus of the pressurized hydrocarbons. Additionally, the high pressure of the hydrocarbons escaping from the damaged blow out preventer or casing string would cause installation of a cover lacking openings to be difficult, if not impossible.

Thus, completely capturing, controlling, or otherwise directing or diverting the flow of hydrocarbons from such a source is generally not possible, as the high pressure of the escaping hydrocarbons resists engagement of any apparatus to the damaged blow out preventer or casing string, and can cause unintended removal of such an apparatus, especially if the flow of hydrocarbons is ever wholly blocked.

A need exists for methods and systems that enable engagement of apparatuses able to control and/or divert flow of hydrocarbons from a high pressure source.

A need also exits for methods and systems that can capture and/or contain hydrocarbons continuously, without causing a pressure build-up.

Embodiments of the present invention meet these needs.

SUMMARY

Embodiments of the present invention relate, generally, to methods and systems usable to control the flow of hydrocarbons from a structure or conduit. Preferred embodiments are usable to engage preexisting subsea structures or conduits, such as a damaged blow out preventer and/or casing string, and/or a hood, cover, or nipple engaged with such a structure or conduit, to prevent spillage of oil or other hydrocarbons into the surrounding ocean.

An apparatus adapted to engage the structure or conduit is provided. Embodiments of the apparatus can include a generally tubular body having a first end with exterior threads thereon, and a second end adapted for connection to adjacent conduits. The threads can include a deformable material, such as rubber, polyurethane, neoprene, or other similar materials, disposed thereon. Alternatively, the threads themselves can be formed from a deformable material. In a preferred embodiment, the first end of the apparatus can have a tapered shape to facilitate engagement with the structure or conduit to which it is to be secured. In an alternate embodiment, the first end of the apparatus can taper in an outward direction and have interior threads disposed therein.

While the specific inner and outer diameter, wall thickness, and thread size and/or spacing of the apparatus can vary depending on the dimensions and characteristics of the structure or conduit to be engaged, in an embodiment, the body of the apparatus can have an outer diameter ranging from approximately 6 inches to 24 inches. Generally, the apparatus is sized and configured such that the threaded end is insertable into and rotatable within a preexisting structure or conduit, the rotation of the apparatus at least partially engaging threads within the preexisting structure or conduit and causing deformation of the deformable material to form a wedge-shaped seal that prevents exodus of fluid and resists disengagement of the apparatus.

In use, the apparatus is lowered into a position for engaging the structure or conduit. The body of the apparatus, itself, can be provided with a weight sufficient to overcome the pressure of fluid exiting from the structure or conduit, or alternatively, one or more weighted objects, such as drill collars, can be secured to the upper end of the apparatus. The weight of the apparatus and any attached weighted objects, in combination with the hydrostatic pressure, determined by the depth of the structure or conduit to be engaged, should exceed the pressure of the hydrocarbons flowing from the structure or conduit, such that the threaded end of the apparatus can be inserted or otherwise positioned in a manner that can engage the structure or conduit.

While lowering the apparatus, an open bore can be maintained through the apparatus and any attached drill collars or other weighted objects to reduce the upward force exerted against the apparatus by water and/or hydrocarbons flowing from the subsea structure or conduit.

After lowering the apparatus to a suitable position, the apparatus can be rotated to engage the threads of the apparatus with a complementary portion of the structure or conduit. Contact between the threads and the structure or conduit deforms the deformable material coating the threads and/or first end of the apparatus to form a wedge shape. The wedge shape provides a seal between the apparatus and the structure or conduit to which it is engaged, while also resisting removal of the apparatus from the structure or conduit due to pressure from flowing hydrocarbons or other forces.

Once the apparatus has been engaged with the structure or conduit, a plurality of additional conduits, and one or more valves, which can include safety valves or other types of valves, can be engaged with an upper end of the apparatus. Subsequently, each upper conduit can be engaged with a respective rig, vessel, pipeline, and/or container. In this manner, the one or more valves can be used to selectively divert hydrocarbons passing through the apparatus to one or more of the upper conduits, such that when a vessel and/or container nears capacity, flow through that particular upper conduit can be ceased without entirely preventing flow from the subsea structure or conduit below, which could cause a pressure build-up and subsequent blowout. While the flow of hydrocarbons is diverted, a vessel and/or container can be disconnected from an upper conduit and replaced with an empty vessel or container without interrupting the flow of hydrocarbons from the structure or conduit below. In an embodiment, testing apparatuses can be provided to determine the presence and/or quantity of gas, saltwater, oil, and/or other components captured from the structure or conduit, and in a further embodiment, one or more return and/or separation apparatuses can be provided to separate, return, and/or discard a portion of the captured materials.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1:
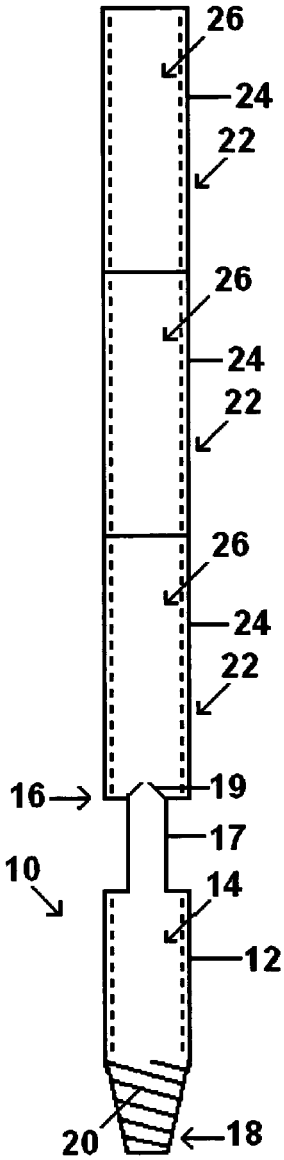
FIG. 1 depicts a side view of an embodiment of an apparatus usable within the scope of the present disclosure, the apparatus having a plurality of weighted members secured thereto to facilitate lowering of the apparatus.

Referring now to FIG. 1, a side view of an embodiment of an apparatus (10) usable to engage a preexisting subsea structure, apparatus, and/or conduit, or similar object, is shown. The apparatus (10) includes a generally tubular body (12) having a bore (14) therethrough. The materials, weight, and dimensions of the body (12) can vary depending on the dimensions and material characteristics of the structure or conduit to which the apparatus (10) is to be engaged, and depending on subsea conditions such as temperature, pressure, current, salinity, or other similar environmental considerations.

The apparatus (10) is shown having an upper end (16), which can be configured for engagement to weighted members, one or more additional conduits, or combinations thereof, through any method known in the art, such as a threaded connection, a force and/or interference fit, welding, use of bolts, rivets, or other fasteners, adhesives, or other similar methods of connection. In the depicted embodiment, the upper end (16) is shown including a narrowed region (17) having a length of about 30 inches, usable to permit a tong or similar apparatus to grip the apparatus (10) when forming a connection with an adjacent component. The narrowed region (17) includes a threaded connection (19) on its upper end, which can engage a bit sub or similar component, sized to engage the threaded connection (19) on a first end, and a drill collar or similar weighted component on a second end. Use of a sub or similar component in this manner enables the apparatus (10) to be engaged with drill collars or other adjacent members having any desired size.

The apparatus (10) is further shown having a tapered lower end (18) with exterior threads (20) thereon, adapted to engage a selected structure or conduit. The spacing and dimensions of the threads (20) and the taper of the lower end (18) can vary depending on the specific structure or conduit to be engaged. The threads (20) can be coated with a resilient and/or deformable material (not shown in FIG. 1), such as rubber, neoprene, polyurethane, or a similar material. In an embodiment of the invention, the threads can be formed from the resilient and/or deformable material rather than coated therewith. In a further embodiment, the lower end (18) of the apparatus (10) can be generally straight, rather than tapered, or alternatively, the lower end (18) can taper in an outward direction.

FIG. 1 depicts the upper end (16) of the apparatus (10) engaged with a plurality of weighted members, shown as drill collars (22), each drill collar (22) having a generally tubular body (24) with a bore (26) therein. While FIG. 1 depicts three drill collars (22) secured to the apparatus (10), defining a continuous bore extending through each drill collar (22) and the apparatus (10), it should be understood that any number and any type of weighted member can be used to facilitate lowering the apparatus (10) into a position suitable for engagement with a subsea structure or conduit. Further, it should be understood that any manner of sub or similar connector can be disposed between the apparatus (10) and the drill collars (22) or other weighted members. In an embodiment of the invention, use of weighted members can be omitted, and the apparatus (10) can itself be provided with a weight sufficient to be lowered to engage the subsea structure or conduit.

Figure 2:
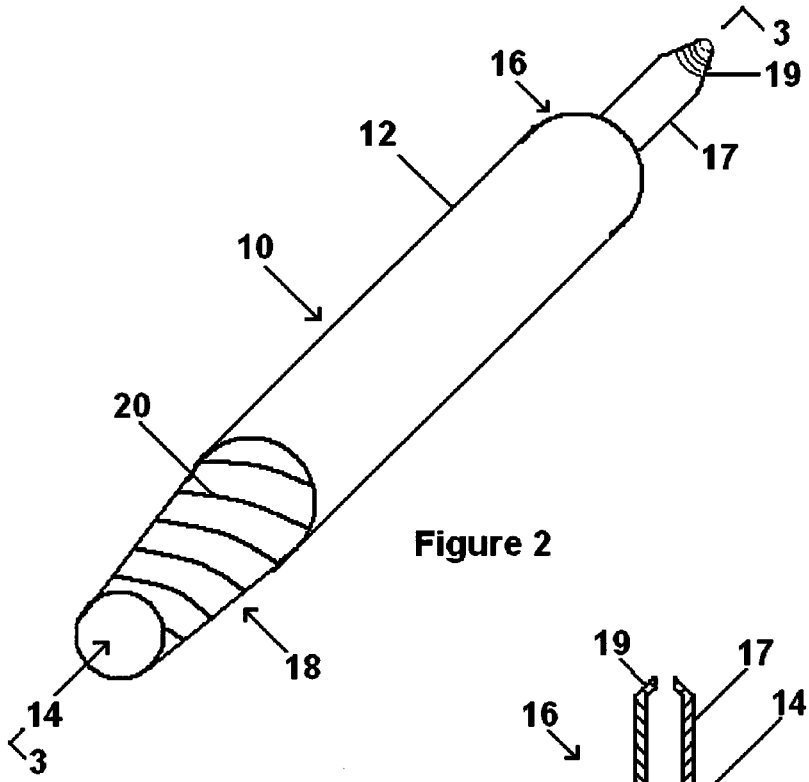
FIG. 2 depicts an isometric view of the apparatus of FIG. 1.
Figure 3:
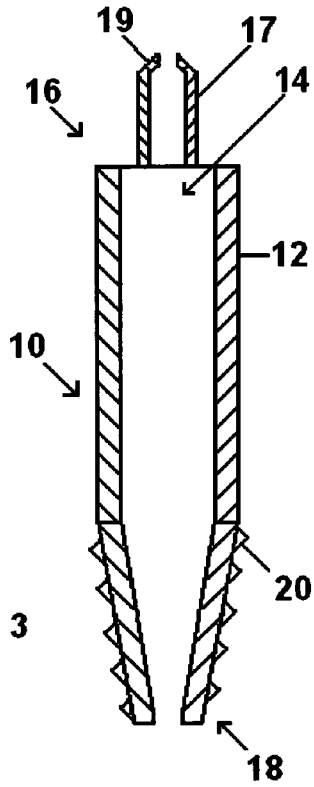
FIG. 3 depicts a side cross-sectional view of the apparatus of FIGS. 1 and 2.

FIG. 2 and FIG. 3 depict an isometric view and a side cross-sectional view taken along section line 3-3 of FIG. 2, respectively, of the apparatus (10), showing the generally tubular body (12) having the bore (14) extending therethrough, the upper end (16) having a narrowed region (17) with a threaded connection (19), and the lower end (18) having exterior threads (20) disposed thereon.

Figure 4B:
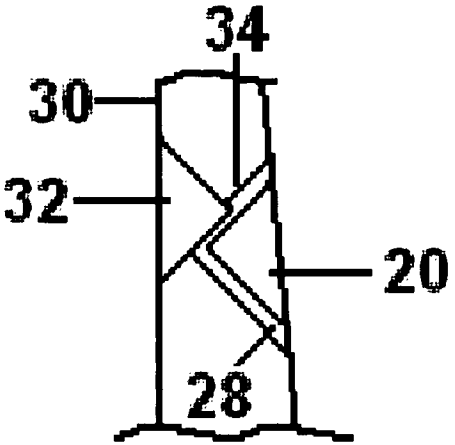
FIG. 4B depicts a partial view of the apparatus of FIG. 4A after engagement with the adjacent apparatus.
Figure 4A:
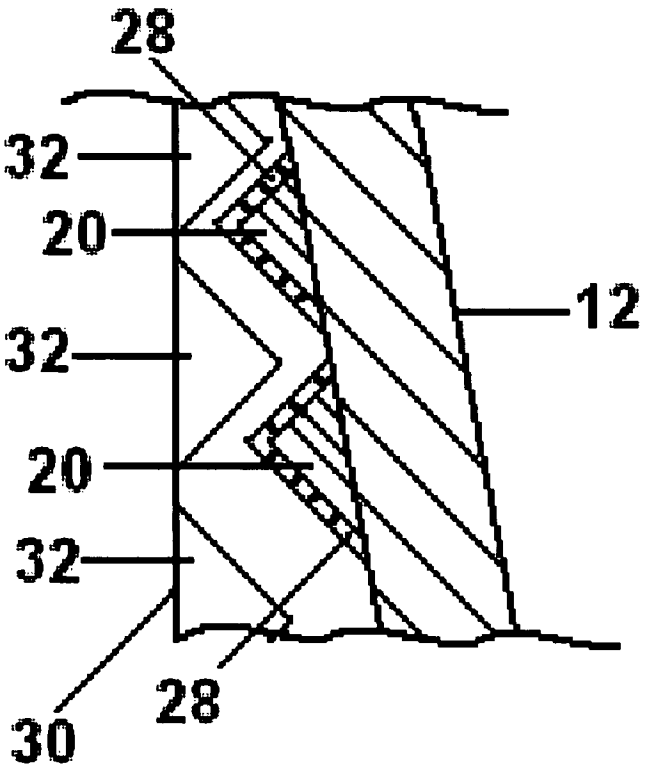
FIG. 4A depicts a partial side cross-sectional view of the apparatus of FIGS. 1-3 adjacent to a structure to be engaged by the apparatus.

Referring now to FIG. 4A, a partial side cross-sectional view of the apparatus is shown. Specifically, a portion of the body (12) having threads (20) disposed thereon is depicted, each of the threads (20) having a coating of a generally deformable material (28), such as rubber, polyurethane, neoprene, or another similar material. The apparatus is shown just prior to engagement with a preexisting structure (30), such as a subsea blowout preventer or segment of casing, the preexisting structure (30) having threads (32) or a similar structural feature suitable for engagement therein.

FIG. 4B depicts a partial view of the apparatus of 4A, during engagement with the preexisting structure (30). Rotation of the apparatus to engage the threads (20) of the apparatus with complementary threads (32) of the preexisting structure (30) causes the deformable material (28) to be compressed and/or otherwise deformed. Deformation of the deformable material (28) in this manner forms a wedge shape (34), which creates a seal between the apparatus and the preexisting structure (30), and also prevents disengagement between the apparatus and the preexisting structure (30) due to pressure caused by flowing hydrocarbons, or other subsea forces. It should be understood that while FIGS. 4A and 4B depict threads (20) coated by a deformable material (28), embodiments of the invention can include threads formed entirely from the deformable material. For example, a coating of deformable material can be applied to the lower end of the apparatus, the coating having multiple spaced grooves such that rotation of the apparatus within the preexisting structure (30) would deform the coating to form a similar wedge shape to prevent removal of the apparatus.

Figure 5:
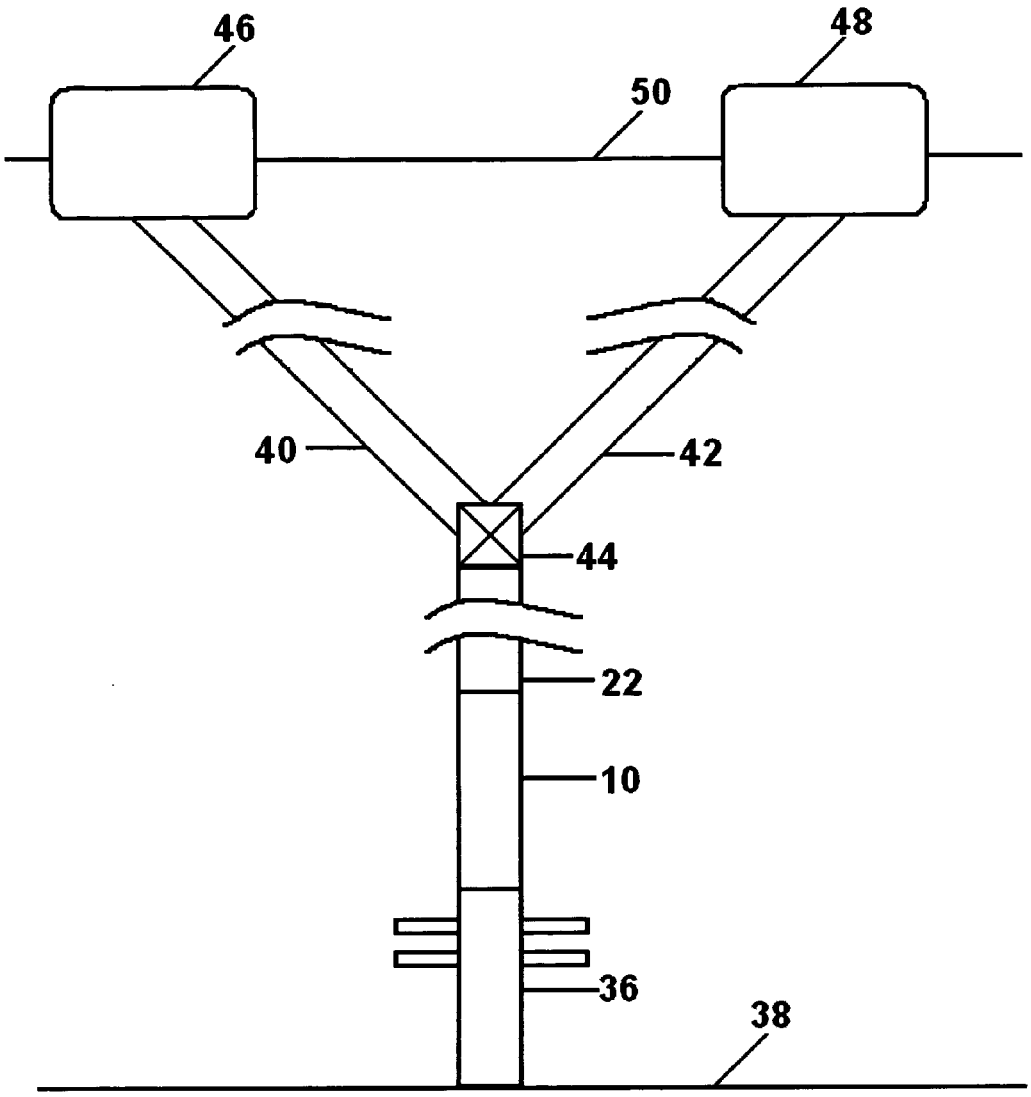
FIG. 5 depicts a diagrammatic view of an embodiment of a system usable within the scope of the present disclosure.

Referring now to FIG. 5, a diagrammatic view of an embodiment of a system incorporating use of the apparatus (10) is depicted. Specifically, the apparatus (10) is shown engaged to a preexisting structure (36), such as a blow out preventer, situated on the ocean floor (38). FIG. 5 further shows one or more drill collars (22) engaged above the apparatus (10); however, as described above, in an embodiment, use of drill collars to lower the apparatus (10) can be omitted, or alternatively, the drill collars can be removed after engaging the apparatus (10) with the structure (36).

A first upper conduit (40) and a second upper conduit (42) are shown engaged to the drill collars (22) by way of a valve (44), such as a safety valve and/or a similar type of valve. The upper conduits (40, 42) can include any manner of drill pipe, casing, coiled tubing, or similar conduit. Each of the upper conduits (40, 42) is shown engaged with a respective vessel (46, 48) disposed at the ocean surface (50). The vessels (46, 48) can include any manner of rig, container, tanker or similar ship, a connection to a pipeline, or other similar apparatuses usable to contain hydrocarbons that flow from the preexisting structure (36) toward the ocean surface (50). The depicted valve (44) is operable to selectively divert hydrocarbons from the structure (36) to either or both of the upper conduits (40, 42). It should be understood that while FIG. 5 depicts two upper conduits (40, 42) configured to flow hydrocarbons to two vessels (46, 48), any number of valves, conduits, and vessels can be engaged with the apparatus (10) to enable selective collection and direction of hydrocarbons from the structure (36). Any manner of testing apparatus and/or separation apparatus (not shown) can be disposed within the apparatus (10), structure (36), conduits (40, 42), valve (44), and/or vessels (46, 48) to measure a quantity of gas, oil, water, or combinations thereof within the flow of hydrocarbons, for selective diversion, separation, containment, return, or discard thereof.

In use, the apparatus (10) can be lowered to a position suitable for engagement with the preexisting structure (36), optionally through use of one or more drill collars (22) engaged with the upper end (16) of the apparatus (10). The weight of the apparatus (10) and drill collars (22), coupled with existing hydrostatic pressure, should exceed the pressure of hydrocarbons escaping from the structure (36). The open bores (14, 26) extending through the apparatus (10) and drill collars (22) further reduce the resistance of water and/or flowing hydrocarbons against lowering of the apparatus (10).

Once the apparatus (10) is lowered to a position suitable for engagement with the structure (36), the lower end (18) of the apparatus can be partially inserted within the structure (36). Subsequent rotation of the apparatus (10) at least partially engages the threads (20) of the apparatus (10) with a complementary portion of the structure (36), thereby deforming the deformable material (28) that coats the threads (20) to form a wedge shape (34). The wedge shape (34) thereby provides a seal between the apparatus (10) and the structure (36) while preventing disengagement of the apparatus (10) from the structure (36).

Upper conduits (40, 42) and one or more valves (44) can be engaged to the upper end (16) of the apparatus (10), or to any attached drill collars (22), such that the valves (44) can be used to selectively divert hydrocarbons or other fluids from the structure (36) that pass through the apparatus (10) and drill collars (22) into one or more upper conduits (40, 42). One or more vessels (46, 48) can be engaged to the upper conduits (40, 42). Hydrocarbons from the structure (36) can thereby flow through the apparatus (10), any attached drill collars (22), and one or both of the upper conduits (40, 42) as determined through operation of the one or move valves (44), to be collected in the vessels (46, 48). When disconnection and/or replacement of a vessel is desired, the one or more valves (44) can be actuated to direct the flow of hydrocarbons to at least one other upper conduit, such that the flow of hydrocarbons from the structure (36) is never completely ceased, while selected vessels can be removed and/or replaced.

Figure 6:
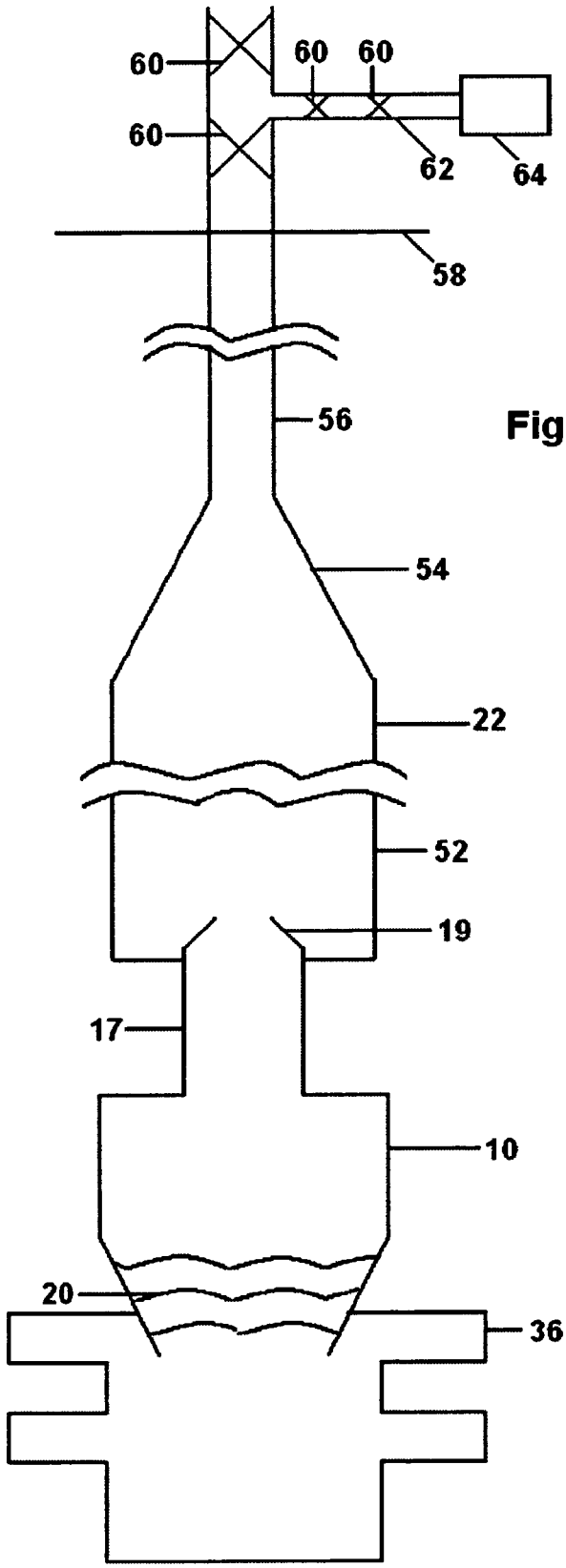
FIG. 6 depicts a diagrammatic view of an alternate embodiment of a system usable within the scope of the present disclosure.

Referring now to FIG. 6, a diagrammatic view of an embodiment of a system incorporating use of the apparatus (10) is depicted. The apparatus (10) is shown having strip-welded threads (20), coated with rubber or a similar material, engaged with the spool of a blow out preventer (36). A narrowed portion (17) of the apparatus (10) protrudes from the end opposite the threads (20), having a length of approximately 30 inches to provide a space for a tong to engage the narrowed portion (17) when securing subs and/or drill collars. A threaded pin end (19) (i.e. having 6.525" threads thereon) of the narrowed portion (17) is shown engaged with complementary threads within a bit sub (52).

The bit sub (52) includes a box end having thread complementary to the threaded pin end (19) of the apparatus, and an opposing end sized for engagement with an adjacent drill collar (22). It should be noted that while FIG. 6 depicts a single drill collar (22) for illustrative purposes, the depicted drill collar (22) can be representative of any number of drill collars or similar weighted devices adapted for connection to the bit sub (52). A crossover sub (54) is shown secured to the upper end of the one or more drill collars (22), the crossover sub (54) being adapted for threaded engagement with the drill collars (22) on a first end, and for threaded engagement with an adjacent segment of drill pipe (56) or a similar conduit on the opposing end.

The drill pipe (56) is shown extending upward, through a rig floor (58), where a series of valves (60) are usable to selectively divert the flow of hydrocarbons and other fluids from the well through a secondary conduit (62) to a testing apparatus (64), which can be used to determine the presence and/or quantity of gas, brine, or other components within the fluid from the well. In an embodiment, a separation apparatus can be used to remove one or more components from the fluid. Fluid not diverted to the testing apparatus (64) can be permitted to flow through the drill pipe (56) for collection in any manner or vessel, container, or similar device. In operation the valves (60) can be actuated to direct the flow of fluid in a manner such that flow from the blow out preventer (36) is never completely ceased, thereby reducing the possibility of a pressure build-up.

While various embodiments of the present invention have been described with emphasis, it should be understood that within the scope of the appended claims, the present invention might be practiced other than as specifically described herein.

What is claimed is:

1. A method for controlling flow of hydrocarbons from a structure or conduit, the method comprising the steps of:

lowering an engagement apparatus into a position for engaging the structure or conduit, wherein the engagement apparatus comprises a tubular body having threads fixedly disposed on an end thereof, and wherein the threads comprise a deformable material fixedly and directly disposed thereon;

rotating the engagement apparatus and the threads to engage the threads directly with a complementary portion of the structure or conduit, thereby deforming the deformable material to form a wedge shape, wherein the wedge shape provides a seal between the threads and the structure or conduit and resists removal of the engagement apparatus from the structure or conduit;

engaging a plurality of conduits and a valve with an upper end of the engagement apparatus; and actuating the valve to direct flow of hydrocarbons from the structure or conduit to a selected conduit of the plurality of conduits.

2. The method of claim 1, wherein the structure or conduit comprises a subsea structure or conduit disposed at a depth, and wherein the step of lowering the engagement apparatus into the position comprises engaging at least one weighted object to the upper end of the engagement apparatus, wherein said at least one weighted object comprises a weight sufficient to provide a force that exceeds a pressure of the hydrocarbons from the subsea structure or conduit less a hydrostatic pressure associated with the depth.

3. The method of claim 2, wherein the step of lowering the engagement apparatus into the position further comprises maintaining an open bore through the engagement apparatus and said at least one weighted object.

4. The method of claim 2, wherein said at least one weighted object comprises a plurality of drill collars.

5. The method of claim 1, wherein the step of engaging the plurality of conduits and the valve with the upper end of the engagement apparatus comprises engaging each conduit of the plurality of conduits with a respective rig, vessel, pipeline, or container, the method further comprising the step of actuating the valve to direct flow of hydrocarbons from the structure or conduit to a second rig, vessel, pipeline, or container to enable disconnection, replacement, or combinations thereof of a first rig, vessel, pipeline, or container.

6. The method of claim 5, wherein the valve comprises a safety valve adapted to direct flow of hydrocarbons to each conduit of the plurality of conduits, to block flow of hydrocarbons from the structure or conduit, or combinations thereof.

7. The method of claim 5, further comprising testing the hydrocarbons from the structure or conduit to measure a quantity of gas, oil, water, or combinations thereof and to selectively control the flow of hydrocarbons from the structure or conduit responsive to the quantity.

8. The method of claim 1, wherein the end of the engagement apparatus having the threads thereon comprises a tapered shape to facilitate engagement with the complementary portion of the structure or conduit.

9. An apparatus for controlling flow of hydrocarbons from a structure or conduit, the apparatus comprising:

a tubular body having a first end and a second end, wherein a bore extends from the first end to the second end, and wherein the first end comprises a tapered shape for facilitating engagement with the structure or conduit; and threads fixedly disposed on the first end, wherein the exterior of the threads comprises a deformable material fixedly and directly disposed thereon, wherein rotation of the tubular body engages the threads directly with the structure or conduit, wherein the first end and the threads are sized for engagement with the structure or conduit, thereby deforming the deformable material to form a wedge shape, wherein the wedge shape provides a seal between the threads and the structure or conduit and resists removal of the first end from the structure or conduit.

10. The apparatus of claim 9, wherein the deformable material comprises rubber, polyurethane, neoprene, or combinations thereof.

11. The apparatus of claim 9, wherein the structure or conduit comprises a subsea structure or conduit, and wherein tubular body comprises a weight sufficient to provide a force that exceeds a pressure of the hydrocarbons from the subsea structure or conduit less a hydrostatic pressure associated with the depth.

12. The apparatus of claim 9, wherein the structure or conduit comprises a subsea structure or conduit, the apparatus further comprising at least one weighted object secured to the second end of the tubular body, wherein said at least one weighted object comprises a weight sufficient to provide a force that exceeds the upward force generated by the flow of the hydrocarbons from the subsea structure or conduit.

13. The apparatus of claim 9, wherein the tubular body comprises an outer diameter ranging from 6 inches to 24 inches.

14. The apparatus of claim 9, wherein an outer surface of the deformable material comprises a substantially similar shape to an outer surface of the threads.

15. A system for controlling flow of hydrocarbons from a structure or conduit, the system comprising:

an engagement apparatus comprising a first end and a second end, wherein the first end has threads fixedly disposed thereon, wherein the threads comprise a deformable material fixedly and directly disposed thereon, wherein the first end and the threads directly contact an inside surface of the structure or conduit, and wherein contact between the threads and the structure or conduit deforms the deformable material to form a wedge shape that provides a seal between the engagement apparatus and the structure or conduit and resists removal of the engagement apparatus from the structure or conduit;

a plurality of conduits engaged with the second end, wherein each of the plurality of conduits engages a respective rig, vessel, pipeline, or container; and a valve disposed in operative communication with the engagement apparatus and the plurality of conduits, wherein the valve is operable to direct flow of hydrocarbons from the structure or conduit to a selected rig, vessel, pipeline, or container to enable disconnection, replacement, or combinations thereof of a first rig, vessel, pipeline, or container.

16. The system of claim 15, wherein the first end comprises a tapered shape for facilitating engagement with the structure or conduit, wherein the threads engage directly with the structure or conduit, and wherein rotation of the engagement apparatus increases forces between the threads and the structure or conduit.

17. The system of claim 15, wherein the deformable material comprises rubber, polyurethane, neoprene, or combinations thereof.

18. The system of claim 15, wherein the engagement apparatus comprises an outer diameter ranging from 6 inches to 24 inches.

19. The system of claim 15, further comprising a testing apparatus configured to measure a quantity of gas, oil, water, or combinations thereof, within the hydrocarbons from the structure or conduit, wherein the valve is actuatable responsive to the quantity.

20. The system of claim 19, further comprising a separation apparatus configured to separate the quantity of gas, oil, water, or combinations thereof from the hydrocarbons from the structure or conduit.

* * * * *